US007174585B1

(12) United States Patent
Sorrentino et al.

(10) Patent No.: US 7,174,585 B1
(45) Date of Patent: Feb. 13, 2007

(54) GROUND COVERING DEVICE WITH INTEGRATED SUPPORT RETENTION AREAS

(75) Inventors: Rita Sorrentino, 30 Beacon Hill Rd., Port Washington, NY (US) 11050; Ronald Walker, New York, NY (US); Brandon Chiovarelli, 72 Avlaon Cir., Smithtown, NY (US) 11787

(73) Assignees: Rita Sorrentino, Port Washington, NY (US); Brandon Chiovarelli, Smithtown, NY (US)

( * ) Notice: Subject to any disclaimer, the term of this patent is extended or adjusted under 35 U.S.C. 154(b) by 0 days.

(21) Appl. No.: 11/173,125

(22) Filed: Jul. 1, 2005

Related U.S. Application Data

(60) Provisional application No. 60/584,567, filed on Jul. 1, 2004.

(51) Int. Cl.
*A47G 9/06* (2006.01)

(52) U.S. Cl. ..... 5/417; 5/485

(58) Field of Classification Search ..... 5/417, 5/419, 485, 490, 413 R; 52/3; 135/116
See application file for complete search history.

(56) References Cited

U.S. PATENT DOCUMENTS

| | | | | |
|---|---|---|---|---|
| 3,226,737 | A | 1/1966 | Rote | |
| 3,689,947 | A | 9/1972 | Wolf | |
| 4,231,125 | A | 11/1980 | Tittl | |
| 4,815,154 | A | 3/1989 | Grimes | |
| 4,815,156 | A * | 3/1989 | Williams | 5/485 |
| 5,072,467 | A | 12/1991 | Hunt | |
| 5,163,192 | A * | 11/1992 | Watson | 5/419 |
| D341,285 | S | 11/1993 | Kraus | |
| 5,644,807 | A | 7/1997 | Battistella | |
| D392,146 | S | 3/1998 | Gregg | |
| 5,729,846 | A | 3/1998 | Sullivan | |
| 5,737,785 | A * | 4/1998 | Casey | 5/419 |
| 5,774,912 | A * | 7/1998 | Dominique | 5/419 |
| D401,105 | S | 11/1998 | Dewees | |
| 6,023,797 | A | 2/2000 | Brumfield | |
| 6,058,530 | A | 5/2000 | Wheeler | |
| 6,192,536 | B1 | 2/2001 | Connors | |
| 6,721,973 | B1 | 4/2004 | Cristiano | |

* cited by examiner

*Primary Examiner*—Michael Trettel
(74) *Attorney, Agent, or Firm*—Hoffmann & Baron, LLP

(57) ABSTRACT

An ergonomic blanket or towel for covering any surface that a person would lay, rest, and/or sit on includes a main body portion and a support portion. At least a portion of the support portion is removably attached to the main body portion, and at least a portion is permanently attached to the main body portion. The support and main body portions are adapted to retain support matter, such as sand or a pillow, therebetween to provide comfortable support to the user, as well as serving to anchor the device. The ergonomic blanket may also include a storage portion, at least a portion of which is removably attached to the main body portion, and at least a portion of which is permanently attached to the main body portion. The storage portion is adapted to retain personal items, such as a wallet, key, comb, glasses, sunscreen lotion, book, and the like. The storage portion may be totally removable from the main body portion.

20 Claims, 18 Drawing Sheets

GROUND COVERING DEVICE WITH INTEGRATED SUPPORT RETENTION AREAS

CROSS REFERENCE TO RELATED APPLICATION

This application claims the benefit of U.S. Provisional Application No. 60/584,567, filed on Jul. 1, 2004, the disclosure of which is incorporated herein by reference.

BACKGROUND OF THE INVENTION

1. Field of the Invention

The present invention generally relates to an ergonomic covering for a variety of surfaces, such as sand, grass, concrete, a couch, bed, floor, chaise, and/or table, which provides an integrated pillow or support area.

2. Description of the Prior Art

Most everyone is familiar with the use of ordinary flat blankets and towels as a ground cover at beaches, parks, pools, massage tables, couches, beds, floors, and chaises. These covering devices generally provide the user with some measure of insulation from heat and moisture that may be present on the ground, as well as protecting surfaces from becoming soiled.

However, the contour of various surfaces that may be encountered, such as sand, grass, concrete, a couch, bed, floor, chaise, table, and/or any surface that a person would lie on is unlikely to provide support and/or elevation to those portions of the user's body conducive to comfort. At the beach, it may be possible to shape or mold sand under that portion of the beach blanket supporting the user's head. However, such a sand formation is readily dispersed, which requires that it be constantly reshaped or replenished by the user. Furthermore, ordinary flat blankets and towels used as a ground cover are not weighted or anchored, and are thus extremely vulnerable to being moved by the wind, especially at beaches. While laying on a chair, bed, couch, or chaise lounge, you can always place a pillow under a portion of the body as desired or needed. However, such a pillow is readily altered and shifted, which requires that it be constantly altered by the user.

OBJECTS AND SUMMARY OF THE INVENTION

It is an object of the present invention to provide a device for covering any surface that a person would lay and/or sit on that incorporates one or more support areas for supporting various portions of the body, which enhance the comfort of the user while serving to anchor or hold the device down.

It is another object of the present invention to provide a device for covering any surface that a person would lie and/or sit on that incorporates one or more support areas, which may be filled with support matter, such as sand, or an inflatable pillow, or any other type of pillow or support matter, which may be weighted or unweighted.

It is yet another object of the present invention to provide a device for covering any surface that a person would lie and/or sit on that incorporates a support area that is readily capable of being filled with sand before use and emptied following use.

It is still another object of the present invention to provide a device for covering any surface that a person would lie and/or sit on that incorporates one or more storage pockets for storing personal items and effects, such as a wallet, key, comb, glasses, sunscreen lotion, book, and the like.

An ergonomic blanket for covering any surface that a person would lie and/or sit on formed in accordance with one form of the present invention, which incorporates some of the preferred features, includes a main body portion or main body portion adapted for being positioned between a person and a surface, which includes a pair of opposing laterally extending end edges, a pair of opposing longitudinally extending side edges, and a support portion. At least a portion of the support portion is removably attached to the main body portion proximate to an end edge, and the removable attachment extends laterally between the side edges.

At least a portion of the support portion is substantially permanently attached to the main body portion between the end edges and extends laterally between the side edges. The main body portion and the support portion define a pocket extending laterally and substantially contiguously from one of the side edges to the opposing side edge. The pocket is open at both side edges and adapted to retain support matter, such as sand, a regular pillow, inflatable pillow, homeopathic pillow, or any other type of pillow, and/or support device, which provides comfortable support to the user, as well as anchoring or holding the device down and limiting its movement.

The ergonomic blanket may also include a storage portion, at least a portion of which is removably attached to the main body portion and at least a portion of which is permanently attached to the main body portion. The storage portion and the main body portion are adapted to retain personal items, such as a wallet, key, comb, glasses, sunscreen lotion, book, and the like therebetween.

A method of ergonomically covering a surface in accordance with one form of the present invention, which incorporates some of the preferred features, includes providing a main body portion adapted for being positioned between a person and a surface, providing a support portion, attaching at least a portion of the support portion removably to the main body portion proximate to an end edge, and attaching at least a portion of the support portion substantially permanently to the main body portion between the end edges. The substantially permanent attachment extends laterally between the side edges. The main body portion and the support portion define a pocket extending laterally and substantially contiguously from one of the side edges to the opposing side edge. The pocket is open at both side edges and adapted to retain support material therein.

An ergonomic blanket system in accordance with one form of the present invention, which incorporates some of the preferred features, includes a main body portion, a support portion, and a storage portion.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
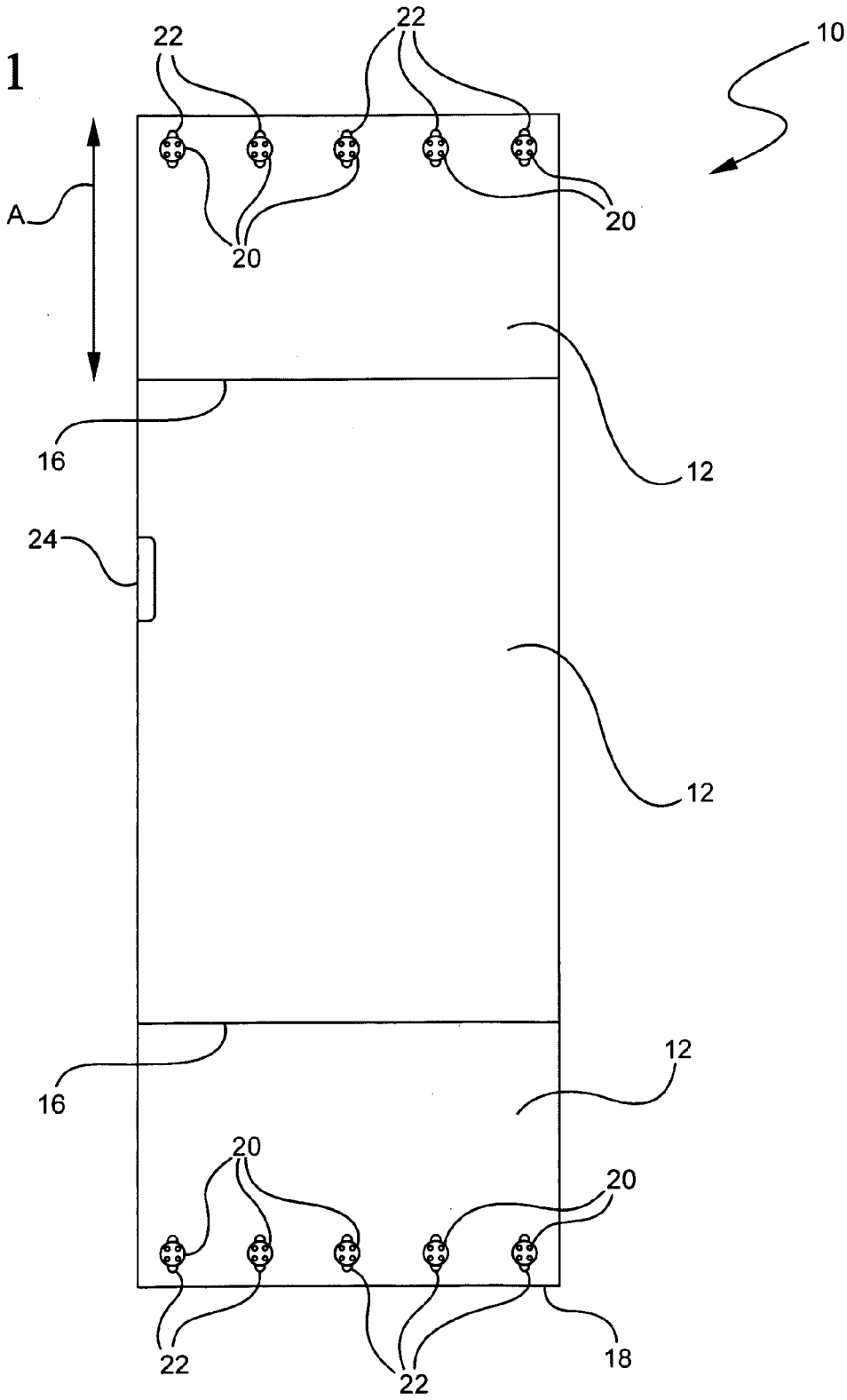
FIG. 1 is a top view of an ergonomic blanket formed in accordance with the present invention in a closed state.
Figure 2:
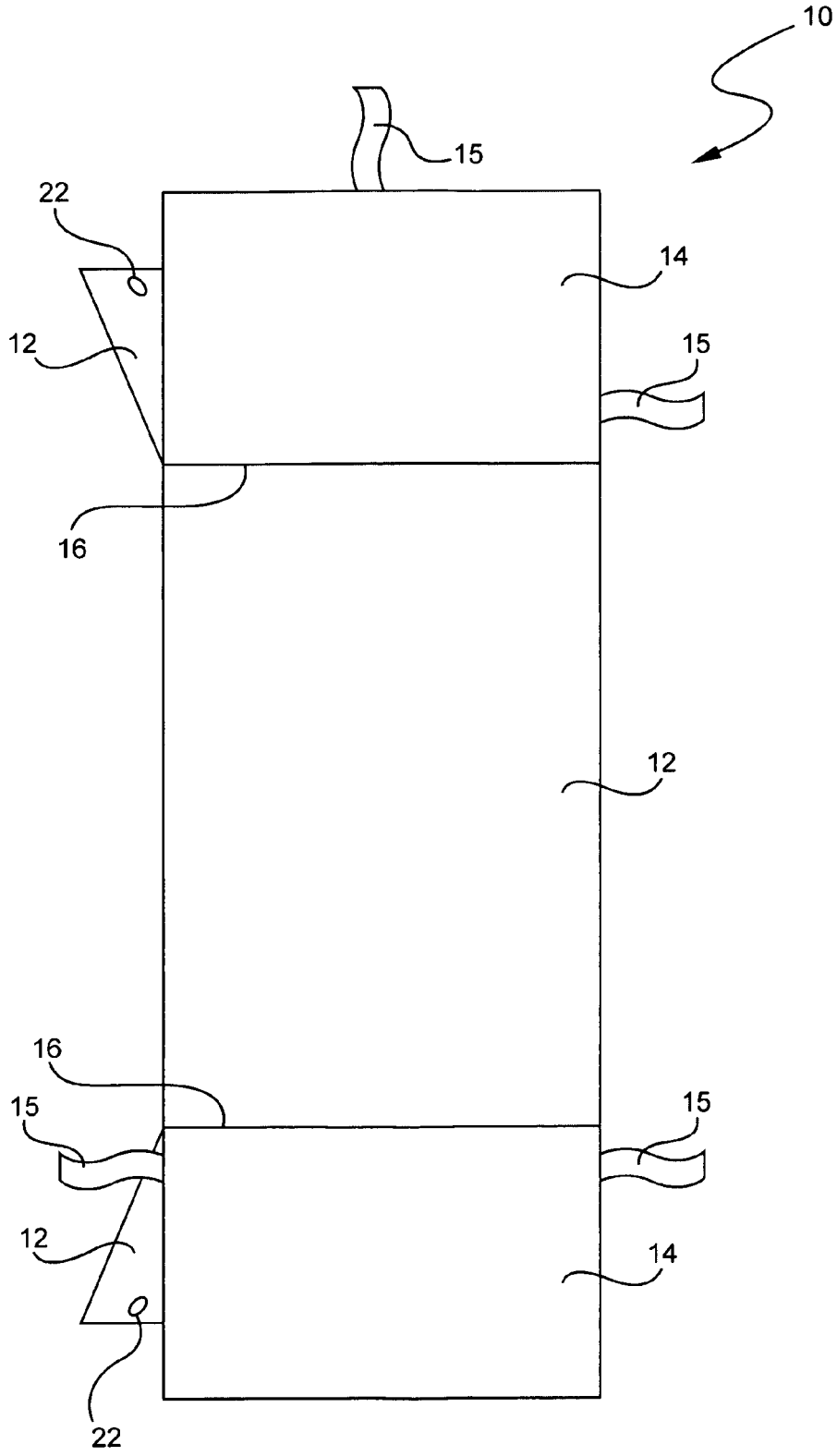
FIG. 2 is a bottom view of the ergonomic blanket shown in FIG. 1 in an open state.

FIGS. 1 and 2 show top and bottom views, respectively, of a surface covering device, pillow towel, or ergonomic blanket 10, which incorporates one or more integrated support retention areas in accordance with the present invention. The ergonomic blanket 10 preferably includes a towel or main body portion 12 and one or more support portions 14, as shown in FIG. 2. The support portions 14 define the support retention areas and are preferably disposed at both ends of the main body portion 12, but may be located elsewhere on the main body portion, to provide support and comfort to the user, as well as serving to anchor the ergonomic blanket 10 when subjected to, for instance, wind at the beach.

The main body portion 12 is preferably a large terry cloth beach towel. The support portions 14 are preferably about eighteen (18) inches long, as measured along a dimension of the main body portion 12 indicated by line A in FIG. 1, and are preferably also manufactured from terry cloth. The support portions 14 are preferably permanently or removably attached to the main body portion 12 along inner edges 16 and removably attached to the main body portion 12 along outer edges 18.

Permanent attachment preferably includes attachment by sewing or stitching, and removable attachment preferably includes attachment with buttons 20 and holes 22, snaps (not shown), hook-an-loop fasteners, or other means well known in the art. The removable attachment points are preferably substantially equally spaced along the outer edges 18. For applications where the ergonomic blanket 10 needs to be secured to an object, such as a chaise, a fastener, such as a strip 15 of elastic fabric or hook-and-loop material may be used to secure the ergonomic blanket 10 to the chaise.

Figure 3:
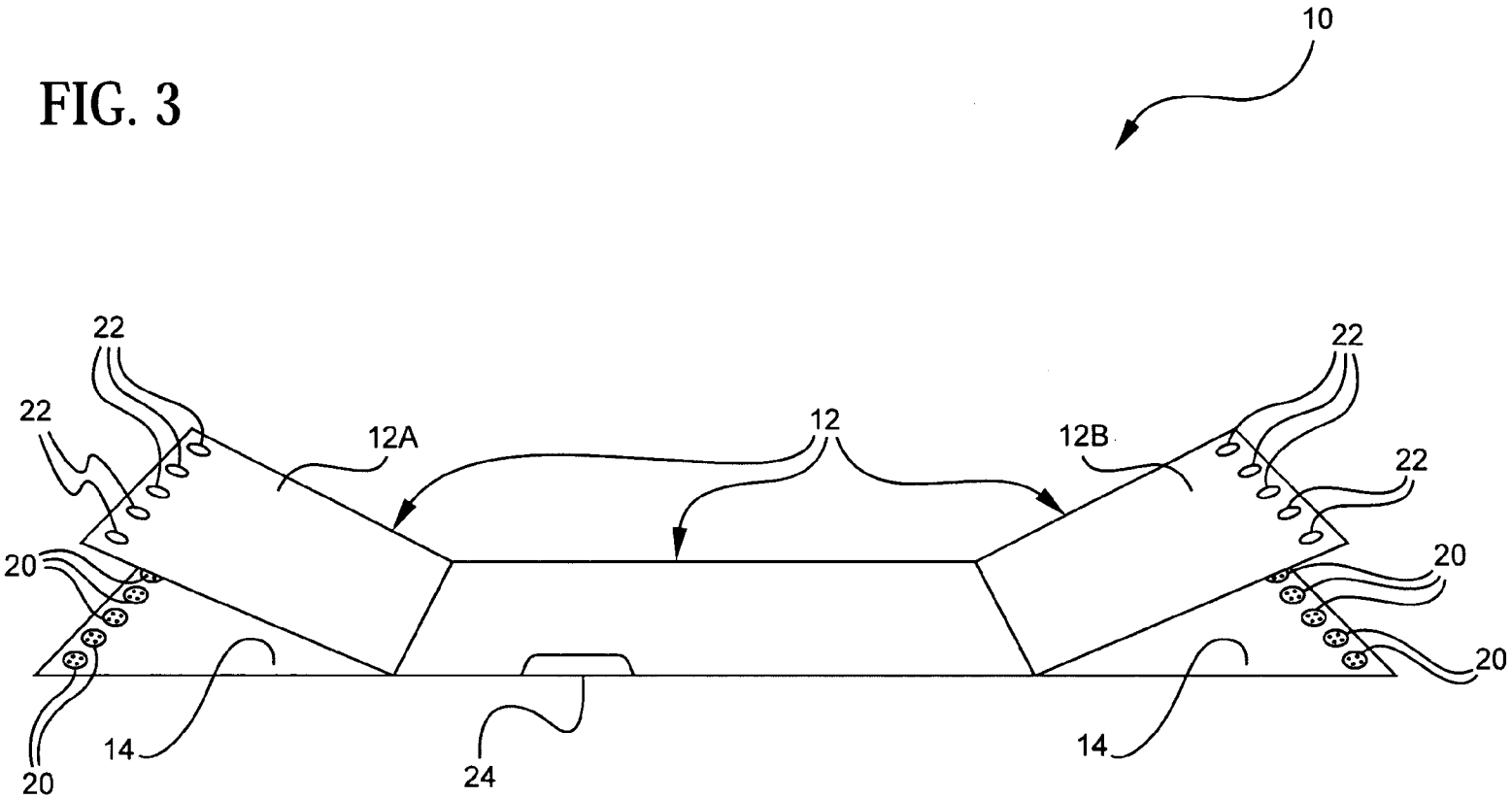
FIG. 3 is a side perspective view of the ergonomic blanket shown in FIG. 1 in the open state.

FIG. 3 is a side perspective view of the ergonomic blanket 10 shown in an open state, wherein the buttons 20 and holes 22 are unconnected, and the support portions 14 are separated from the raised main body portion 12 at the seams. The holes 22 are preferably equally spaced apart at about eight (8) inches with respect to each other on each of the main body portions 12A, 12B. Further, the position of the holes 22 on the main body portion 12A preferably mirrors the position of the holes 22 on the main body portion 12B. In addition, the holes 22 on the main body portions 12A 12B are preferably aligned with corresponding buttons 20 on the main body portion 14. A storage pocket 24 is shown as being disposed on the underside of the main body portion 12.

Figure 4:
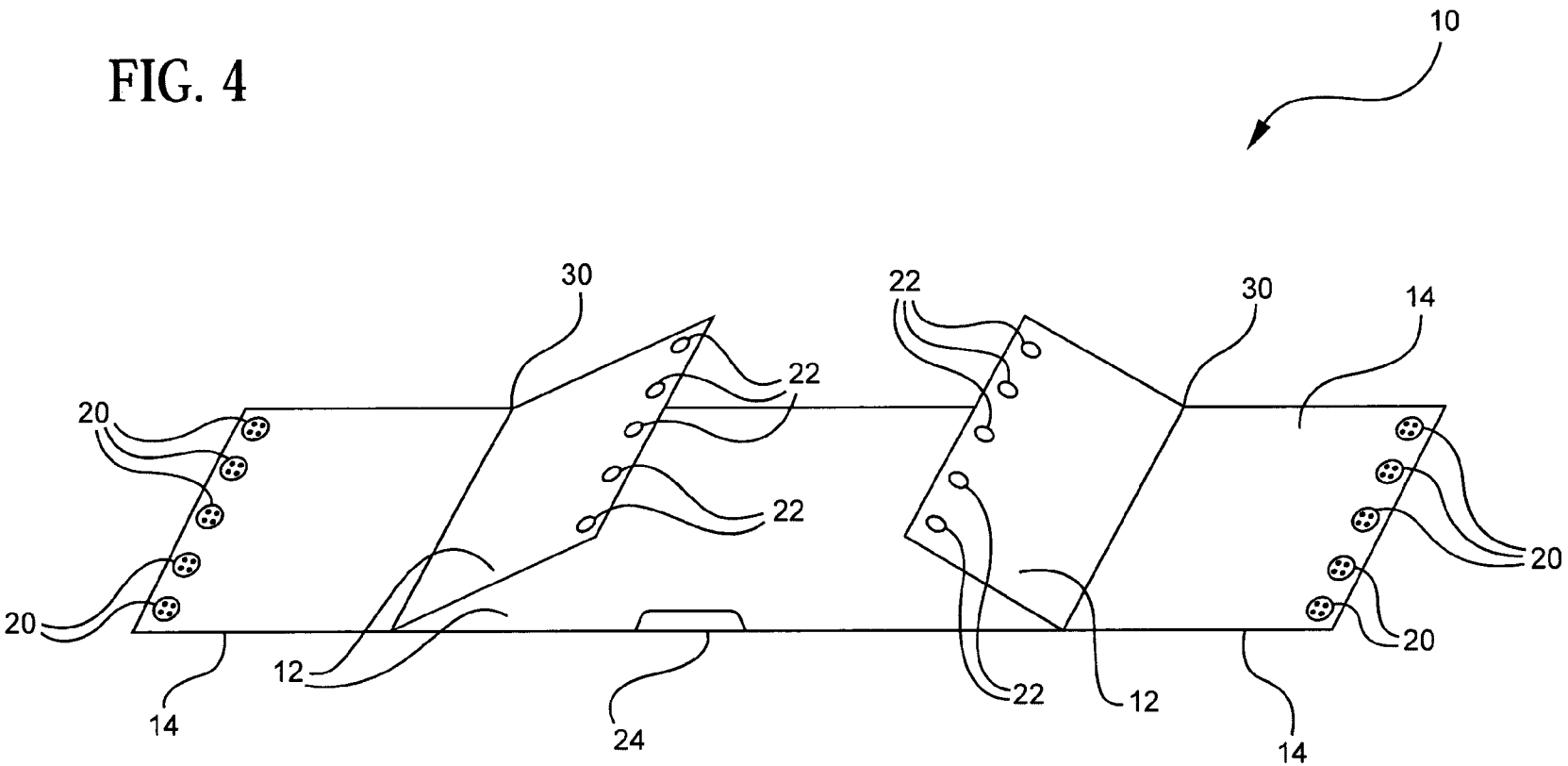
FIG. 4 is a side perspective view of the ergonomic blanket shown in FIG. 1 in the open state.

FIG. 4 is another side perspective view of the ergonomic blanket 10 showing the support portions 14 further separated from the main body portion 12 to expose a finished seam that is preferably used to affix the support portions 14 to the main body portion 12. Lengthwise sections 30 of the support portions 14 are preferably sewn to the main body portion 12 and then the support portions 14 are folded back on top of the lengthwise portions 30 to essentially hide the stitching from external view in much the same manner as a pillowcase is made.

Figure 5:
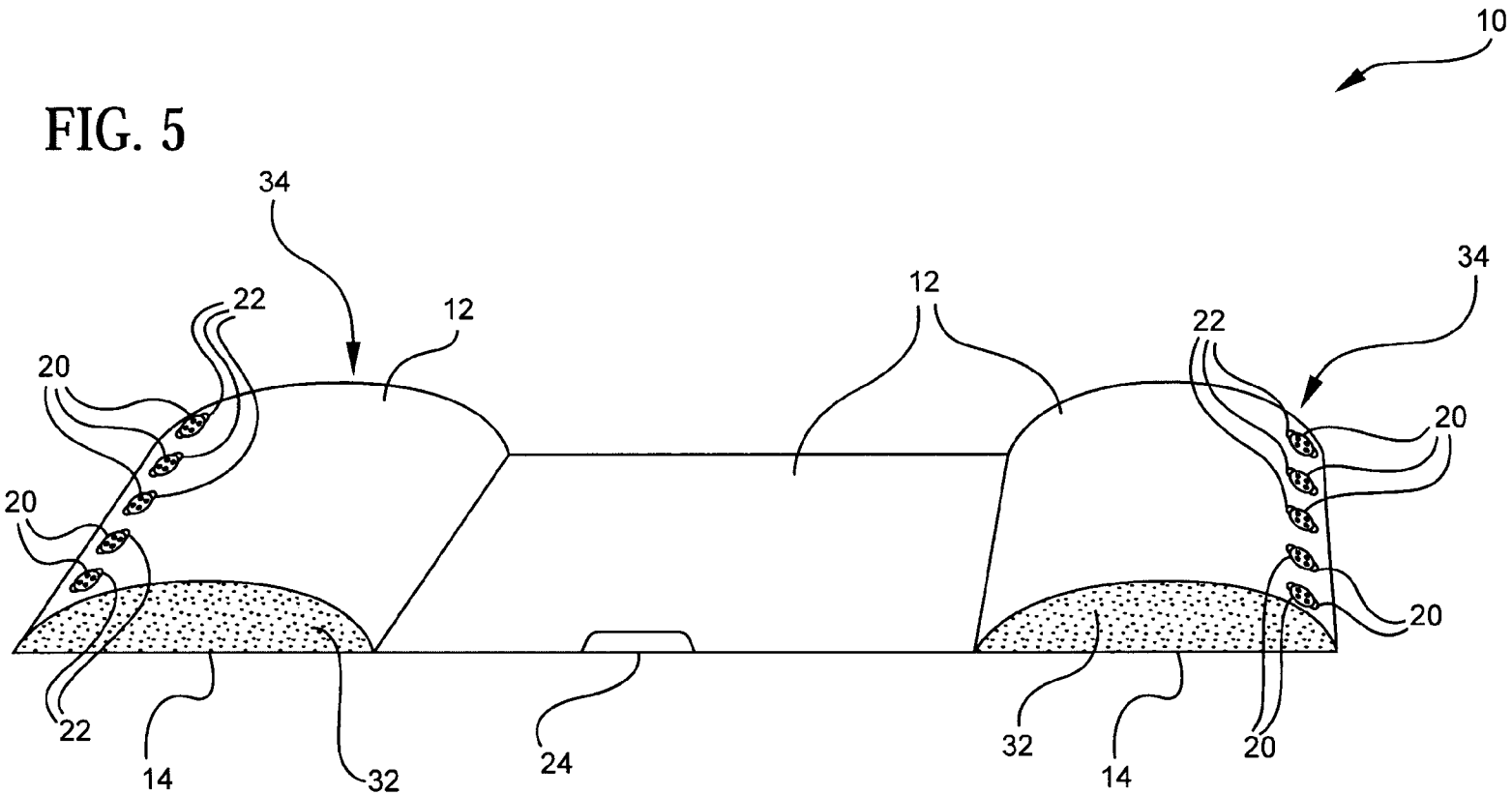
FIG. 5 is a side perspective view of the ergonomic blanket in the closed state, wherein sand has been inserted between a main body portion and two support portions of the ergonomic blanket.

FIG. 5 is a side perspective view of the ergonomic blanket 10 in a closed state, wherein sand 32 has been inserted and retained between the support portions 14 and main body portion 12. In this view, the removable attachments 20, 22 have been connected generally creating one or more pillow or support areas 34. Thus, it can readily be understood that the ergonomic blanket 10 formed in accordance with the present invention provides a means for effectively trapping and retaining sand to create a comfortable support area for various portions of the body, as well as anchoring the ergonomic blanket 10 firmly in place. As indicated above, the support areas 34 are preferably located at the lengthwise ends of the ergonomic blanket 10, but may be located anywhere and/or throughout the ergonomic blanket 10 while remaining within the scope of the present invention.

Figure 6A:
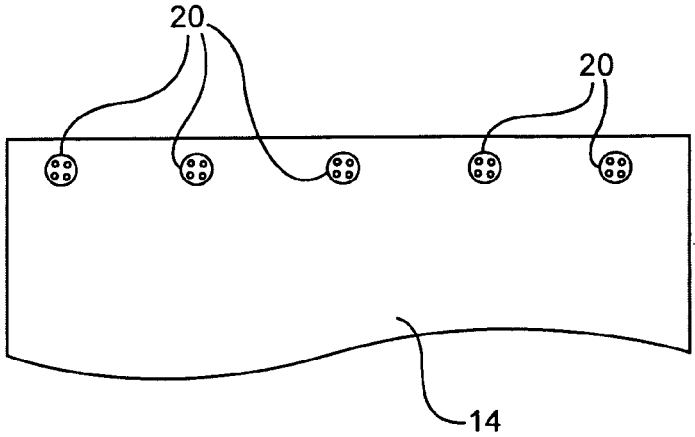
FIG. 6*a* is a top view of the support portion of the ergonomic blanket.
Figure 6B:
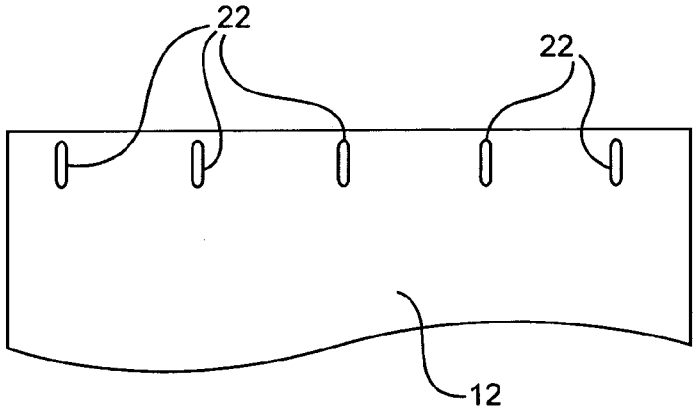
FIG. 6*b* is a top view of the main body portion of the ergonomic blanket.
Figure 6C:
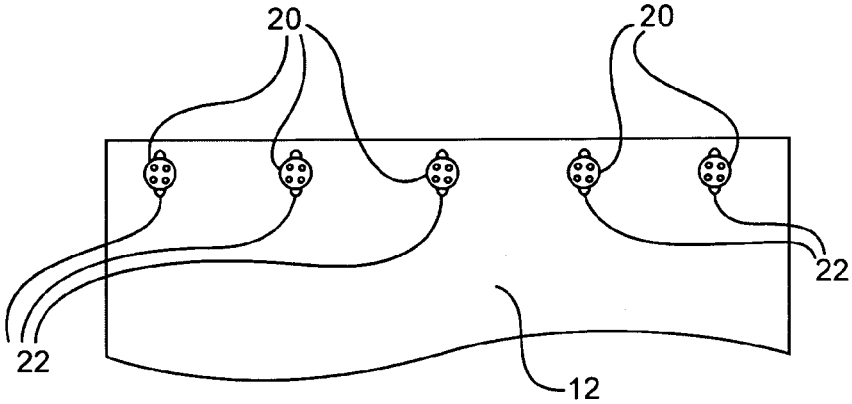
FIG. 6*c* is a top view of the main body portion removably fastened to the support portion of the ergonomic blanket.

FIG. 6*a* shows a section of the support portion 14 that includes buttons 20 attached thereto, and FIG. 6*b* shows a section of the main body portion 12 that includes holes 22 sewn therethrough. FIG. 6*c* shows a top view of the main body portion 12 removably fastened to the first flap portion 14 of the ergonomic blanket using the button 20 and hole 22 fasteners.

Figure 7:
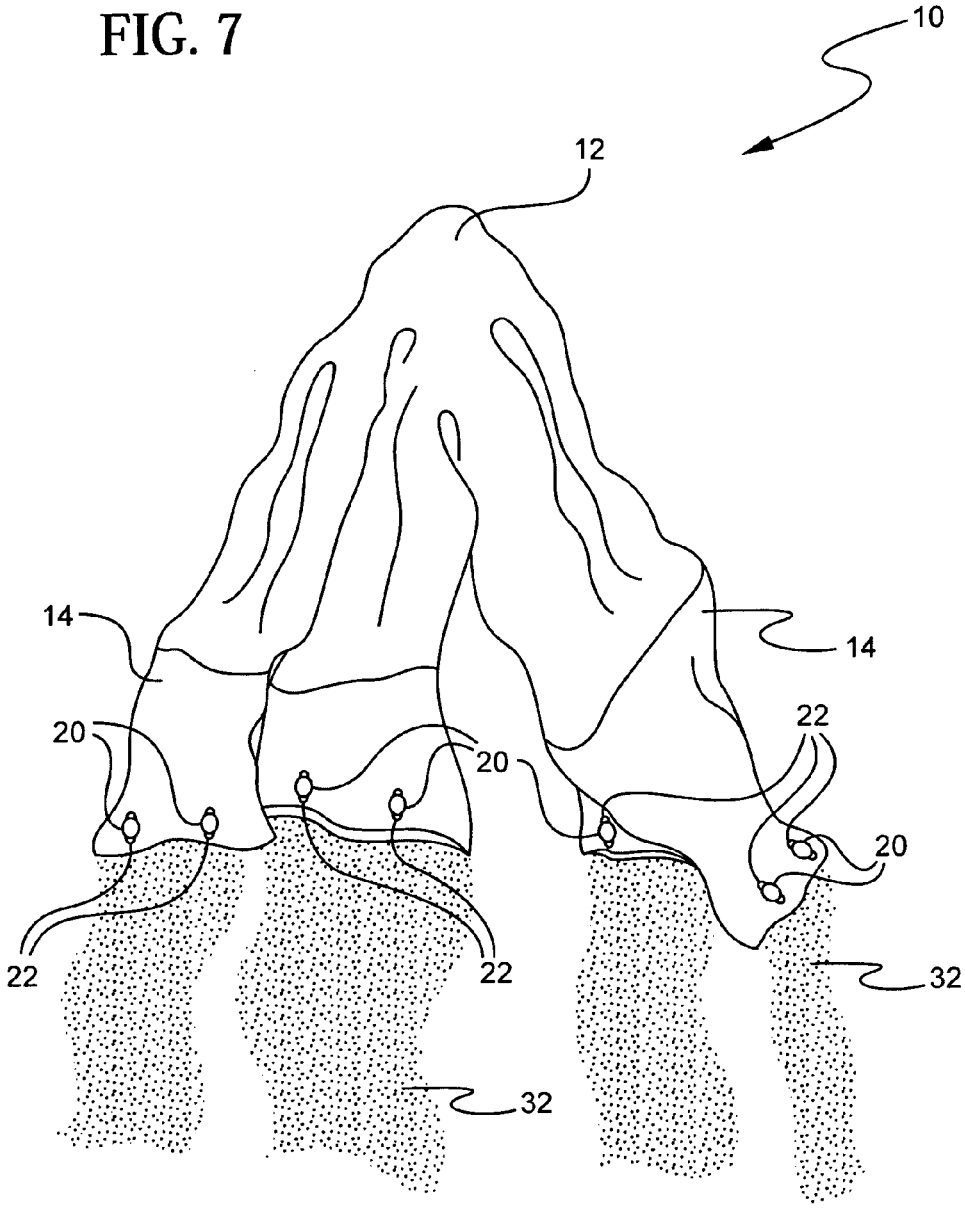
FIG. 7 shows sand being emptied from the ergonomic blanket.

FIG. 7 shows the ergonomic blanket 10 being lifted from the center of the main body portion 12 to empty sand 32 from its semi-enclosed retention areas, which is disposed between the main body portion 12 and the support portions 14, following use. Spacing between successive removable attachments 20, 22 along the outer edges advantageously enables sand to be completely emptied from the ergonomic blanket 10 without requiring the user to open the removable attachments 20, 22.

Figure 8A:
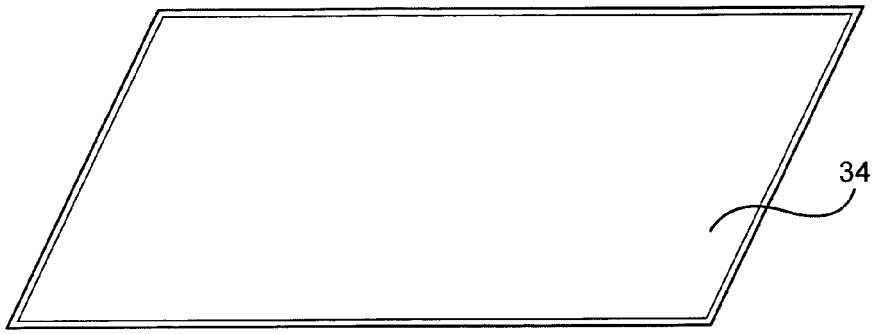
FIGS. 8*a* and 8*b* are perspective views of a first embodiment of an inflatable pillow in a deflated state and an inflated state, respectively, which is adapted for retention by the ergonomic blanket in accordance with the present invention.
Figure 8B:
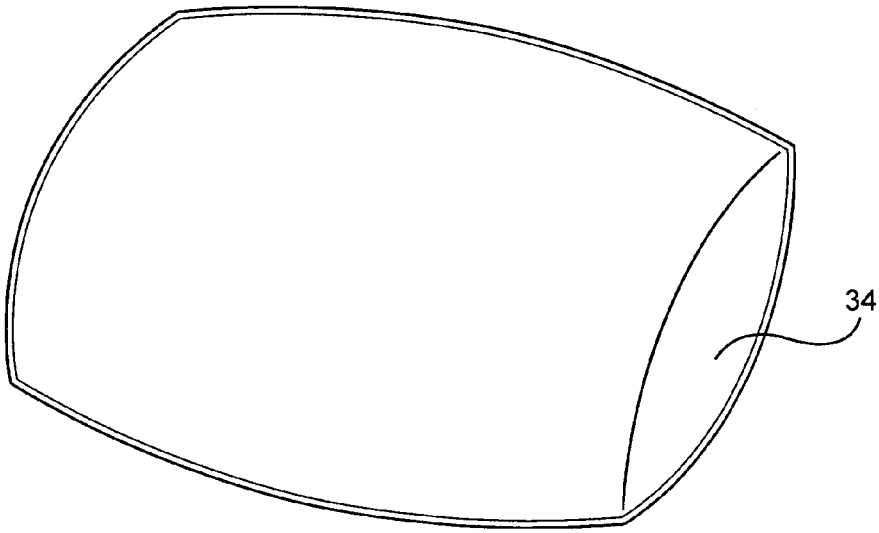

FIGS. 8*a* and 8*b* show a first embodiment of a pillow 34 in a deflated state and an inflated state, respectively. The pillow 34 is preferably inserted between the main body portion 12 and the support portion 14 when, for instance, the ergonomic blanket is used at a location other than the beach, such as a park or pool. Non-inflatable pillows, foam pillows, feather pillows, polyester pillows, homeopathic pillows, and the like may also be used while remaining within the scope of the present invention.

Figure 9A:
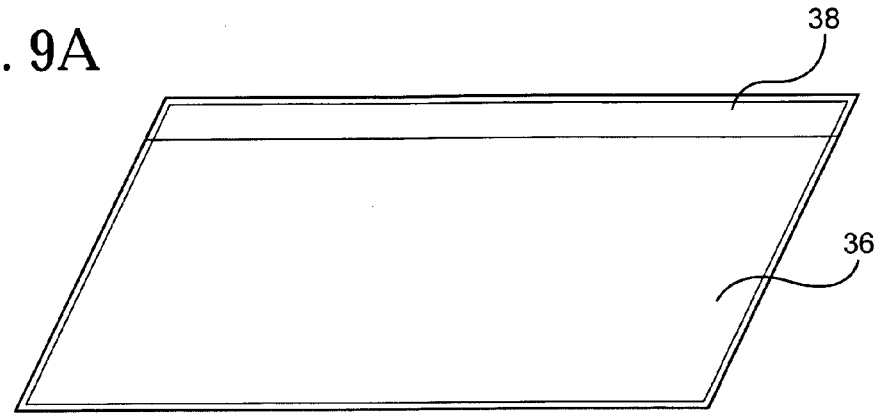
FIGS. 9*a* and 9*b* are top perspective views of a second embodiment of the inflatable pillow in the deflated state and inflated state, respectively.
Figure 9B:
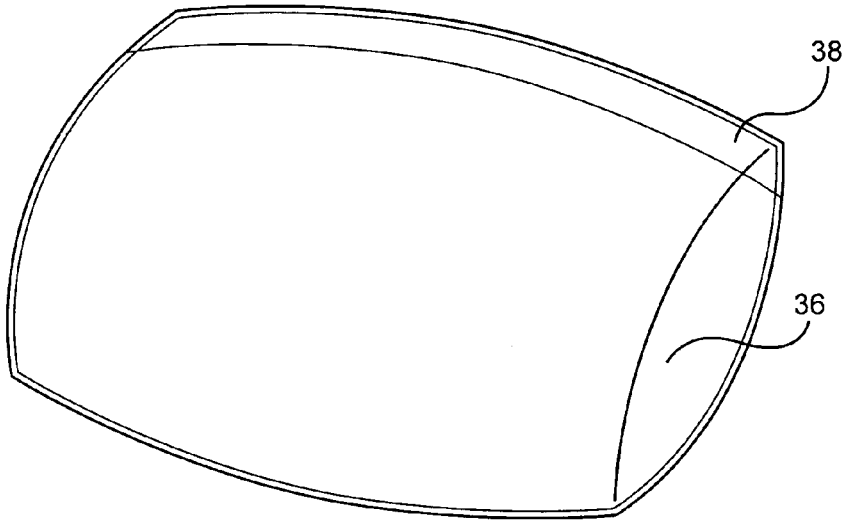

FIGS. 9*a* and 9*b* show a second embodiment of a pillow 36 in the deflated state and inflated state, respectively. The pillow 36 is substantially similar to the pillow 34 shown in FIGS. 8*a* and 8*b*, except that the pillow 36 incorporates a weighted portion 38, which is preferably enclosed by seams in the pillow 36. The pillows 34, 36 are preferably manufactured from plastic, foam, and/or the like.

Figure 10:
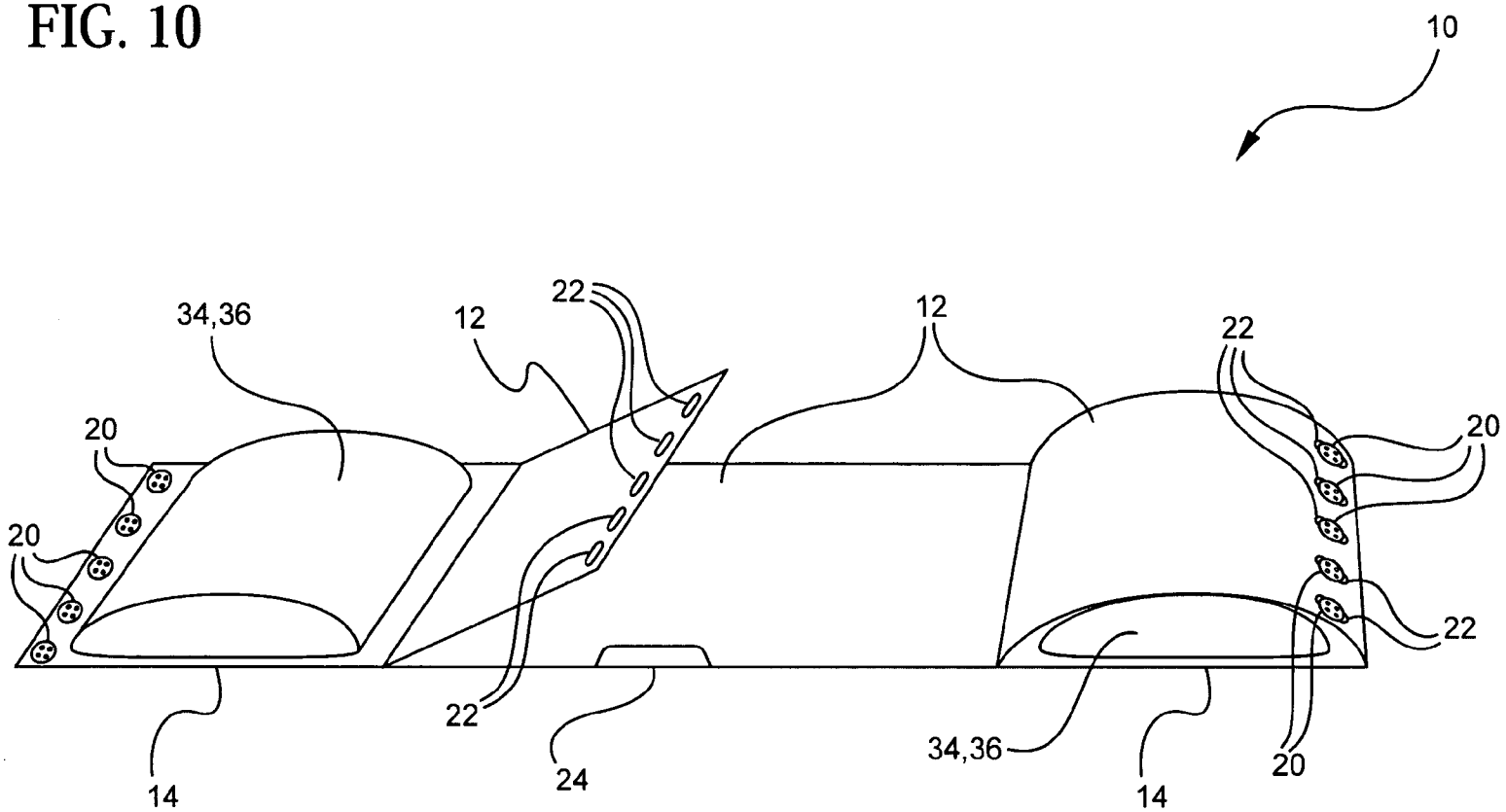
FIG. 10 is a side perspective view of the inflatable pillow, regular pillow, and/or any type of pillow or support device shown in FIGS. 8*a*, 8*b*, 9*a*, and 9*b* applied to the ergonomic blanket in accordance with the present invention.

FIG. 10 is a side perspective view of the pillow 34, 36 inserted in the ergonomic blanket 10, which may be any type of pillow and/or support device. At one end of the ergonomic blanket 10, the main body portion 12 is separated from and unconnected to the support portion 14, thereby exposing the pillow 34, 36 resting on the support portion 14. At the opposite end of the ergonomic blanket 10, the main body portion 12 and the support portion 14 are connected to thereby retain the pillow or support device 34, 36.

Figure 11:
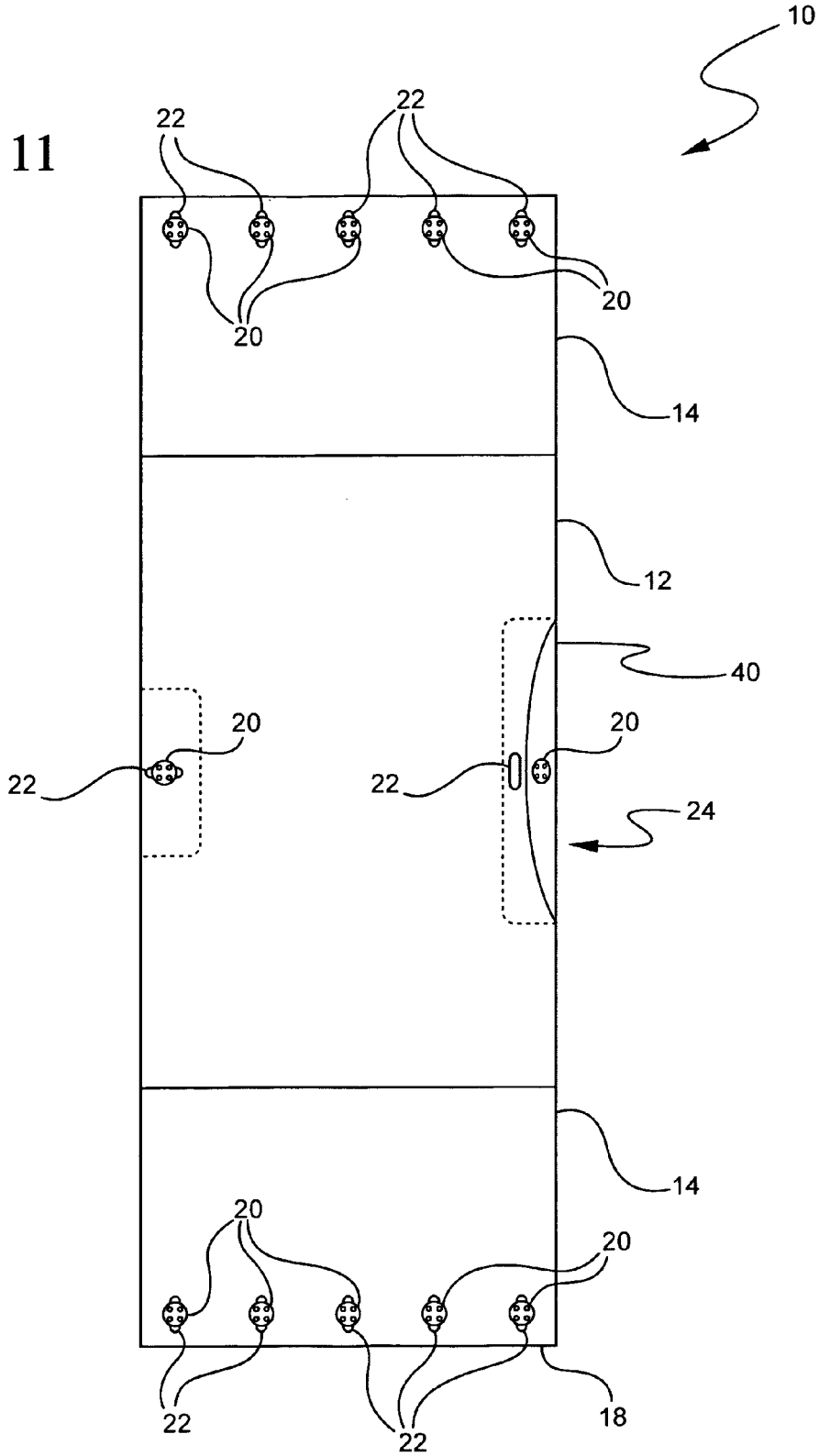
FIG. 11 is a top view of the ergonomic blanket showing storage pockets.
Figure 12:
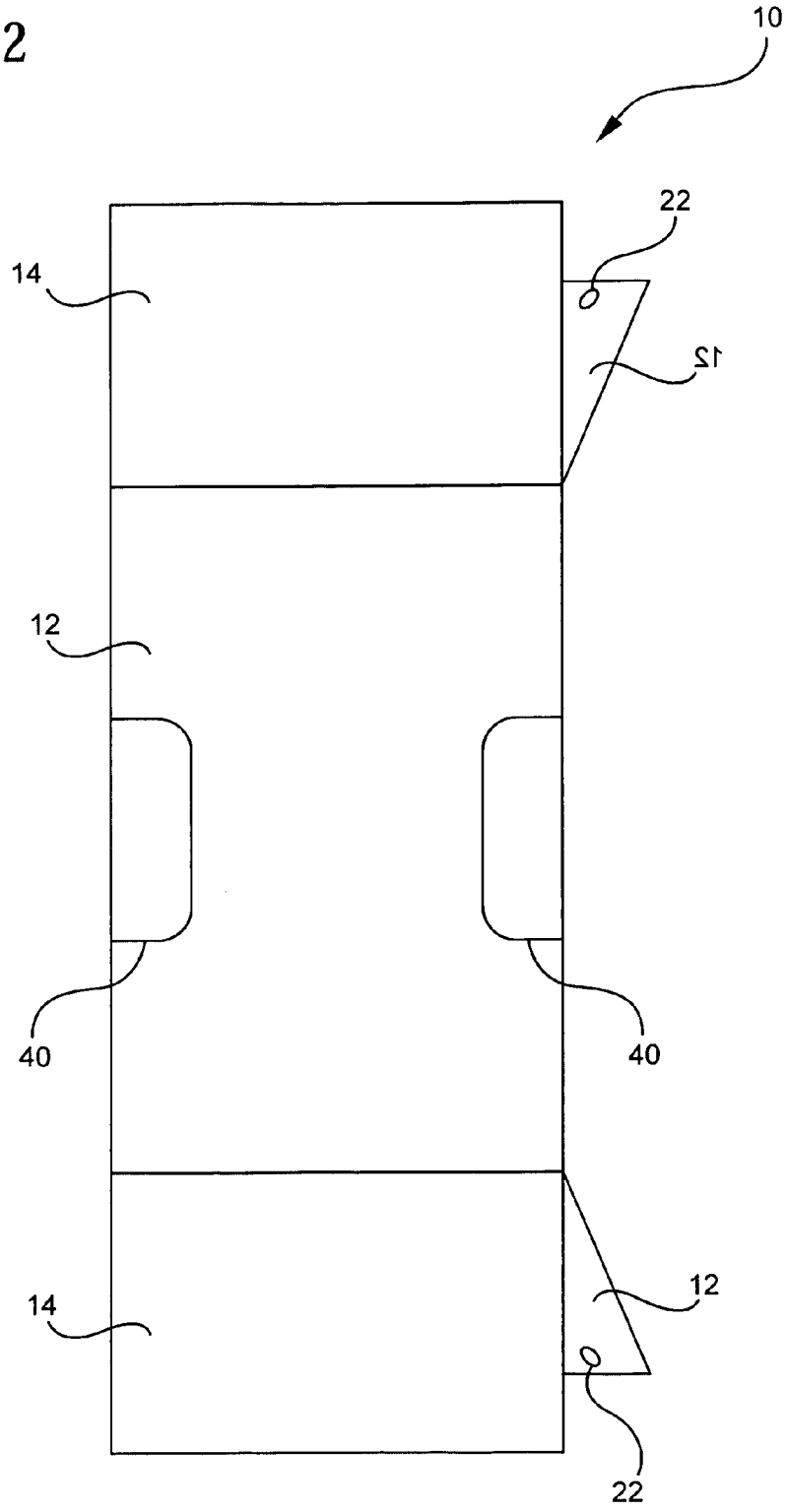
FIG. 12 is a bottom view of the ergonomic blanket showing the storage pockets.

FIG. 11 is a top view of the ergonomic blanket 10 showing one embodiment of the storage pockets 24, which may be located at the sides of the ergonomic blanket 10. In this embodiment, the storage pockets 24 preferably include a storage portion 40 sewn onto the underside of the main body portion 12 of the ergonomic blanket 10. The storage pockets 24 also preferably include a removable fastener 20, 22, which removably attaches the storage portion 38 to the main body portion 12. The removable fastener 20, 22 enables the user to insert items into the storage pocket 24 when open and retains the contents of the storage pocket 24 when closed. The button 20 is preferably attached to the storage portion 40 and the hole 22 is preferably attached to the main body portion 12. FIG. 12 is a bottom view of the ergonomic blanket 10 showing the storage portions 40 sewn onto the main body portion 12 of the ergonomic blanket 10.

Figure 13:
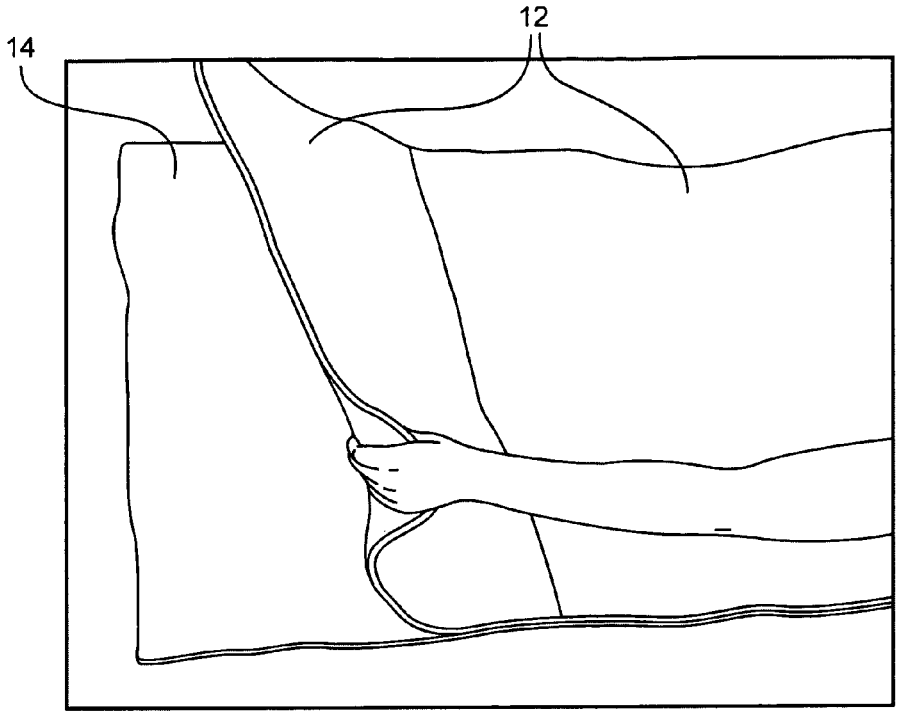
FIG. 13 is a pictorial end view of a portion of the ergonomic blanket showing the main body portion and the support portion.
Figure 14:
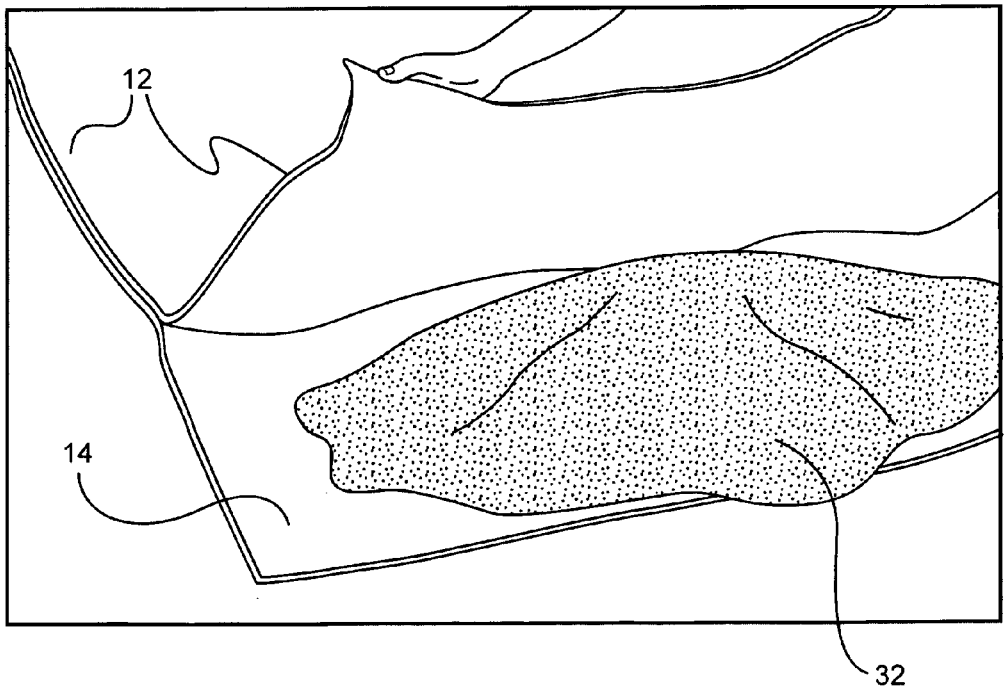
FIG. 14 is a pictorial end view of a portion of the ergonomic blanket showing the main body portion and the support portion filled with sand.
Figure 15:
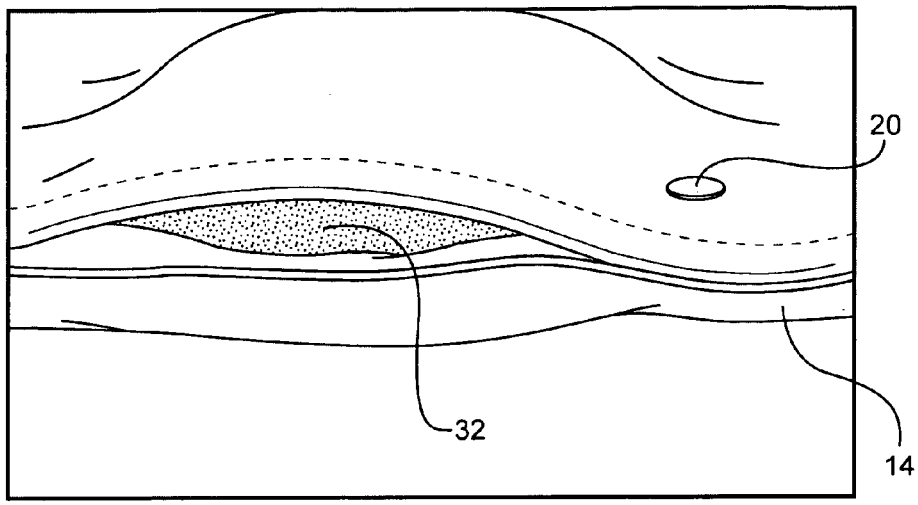
FIG. 15 is a pictorial end view of a portion of the ergonomic blanket showing sand being retained between the main body portion and the support portion.
Figure 16:
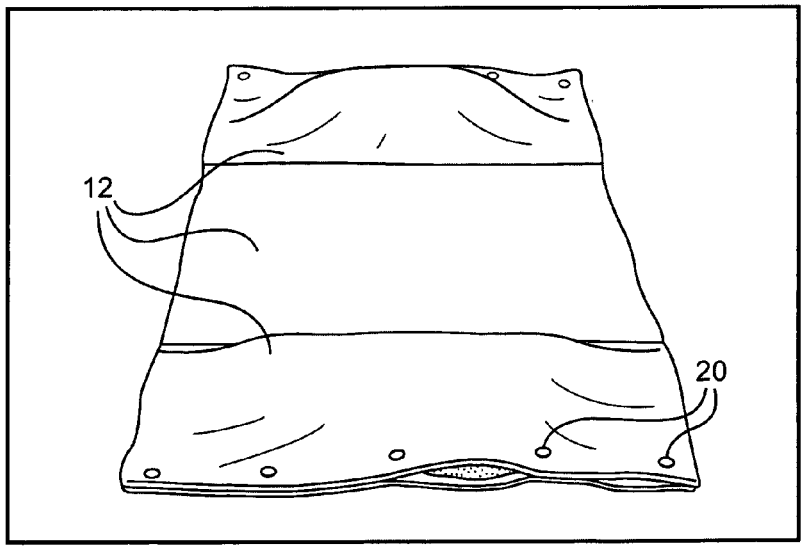
FIG. 16 is a pictorial top view of the ergonomic blanket showing sand being retained between the main body portion and the support portion.
Figure 17:
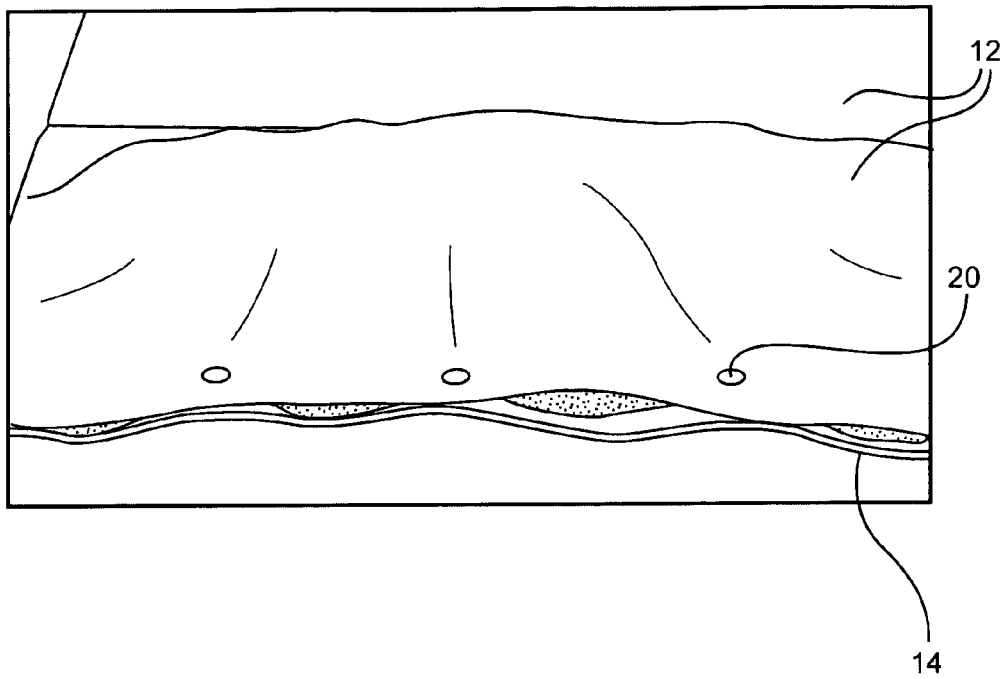
FIG. 17 is a pictorial end view of the ergonomic blanket showing sand being retained between the main body portion and the support portion.
Figure 18:
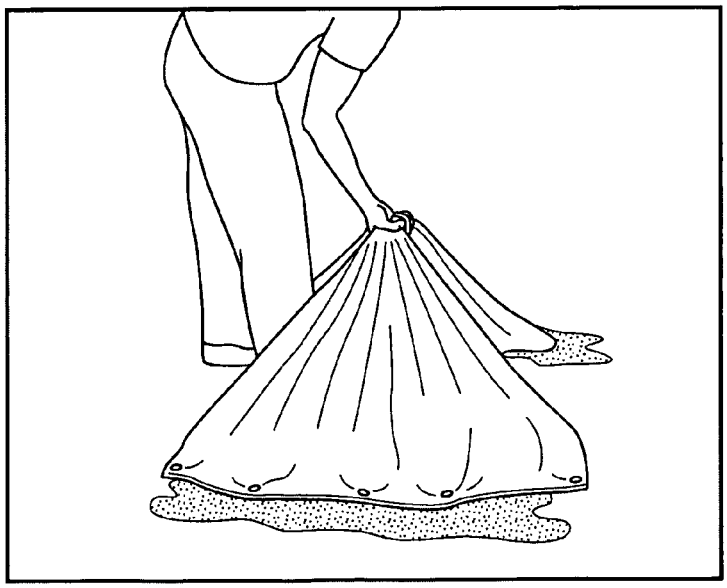
FIGS. 18–20 are pictorial views of sand being emptied from the ergonomic blanket in accordance with the present invention.
Figure 19:
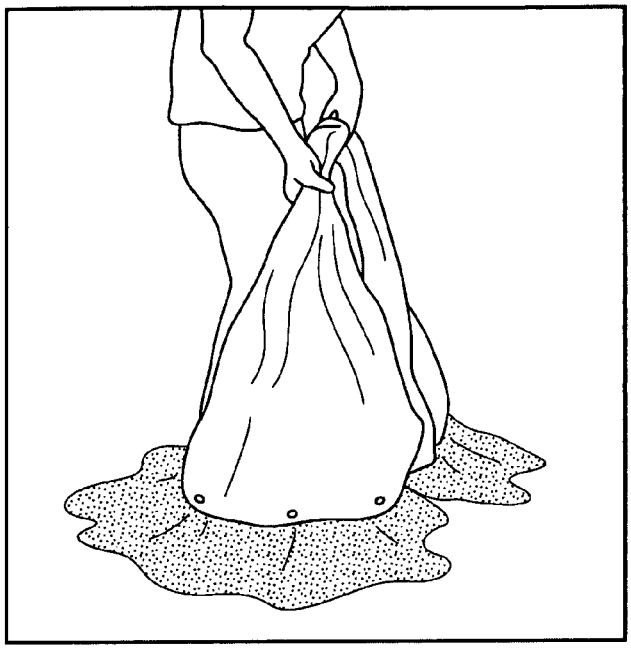
Figure 20:
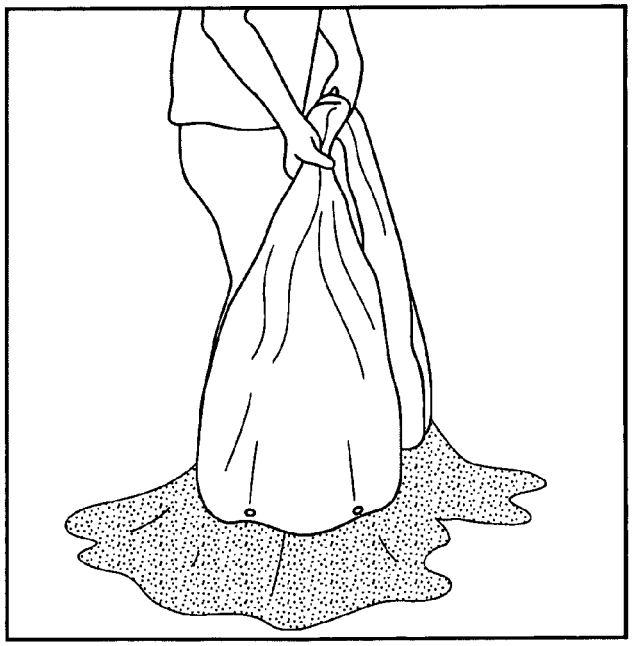

FIG. 13 is a pictorial view of the main body portion 12 being lifted from the support portion 14 of the ergonomic blanket 10, and FIG. 14 shows sand being placed on the support portion 14 for retention by the ergonomic blanket 10. FIGS. 15–17 are pictorial views of sand being retained by the ergonomic blanket 10, and FIGS. 18–20 show sand being emptied from the ergonomic blanket 10 in accordance with the present invention.

Figure 21:
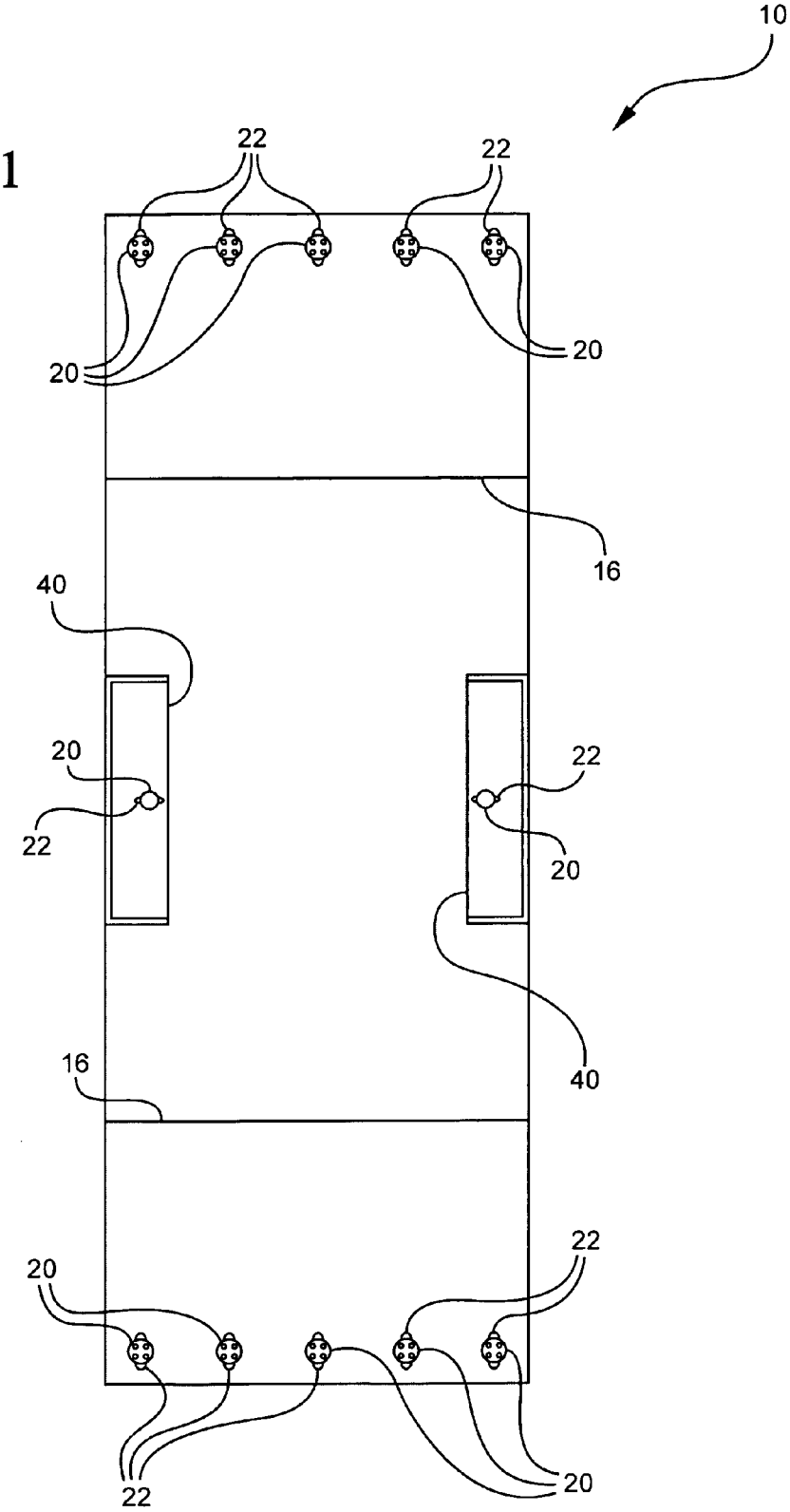
FIG. 21 is a top view of the ergonomic blanket showing the storage pockets.
Figure 22:
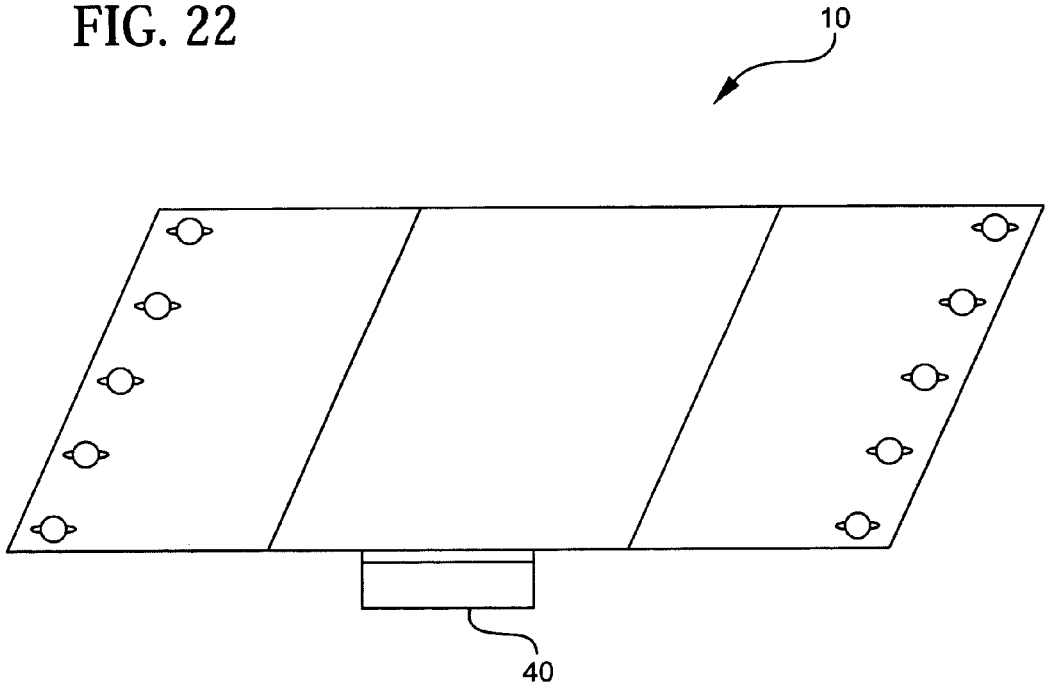
FIG. 22 is an isometric view of the ergonomic blanket showing the storage pocket attached to the side of the blanket.

It is anticipated that variations in the following may be incorporated in the ergonomic blanket while remaining well within the scope of the present invention:

1. size, location, material, and quantity of support portion (s);
2. size, location, spacing, quantity, and type of removable fastener(s);
3. size, location, quantity, degree, and type of permanent attachment(s);
4. size, location, material, and quantity of storage portion (s), such as that shown in FIG. 21, wherein the storage portion is located on top of the main body portion, or in FIG. 22, wherein the storage portion 40 extends or hangs from the side of the main body portion;
5. size and location of that portion of the support portion (s) being removably attached to main body portion;
6. size and location of that portion of the support portion (s) being permanently attached to main body portion;
7. size and location of that portion of storage portion(s) being removably attached to main body portion, such as that shown in FIG. 21, wherein the storage portion opens towards the inside of the main body portion rather than on an outer edge of the main body portion to prevent sand from entering the ergonomic blanket;
8. size and location of that portion of the storage portion (s) being permanently attached to main body portion;
9. size and material of main body portion;
10. size, quantity, consistency, and type of support matter retained by the ergonomic blanket; and
11. The storage pocket 24 may be totally removable from the main body portion by, for instance, positioning removable fasteners along all edges of the storage pocket 24. The storage pocket 24 may also function as a complete enclosure or envelope for items therein when removed from the ergonomic blanket.

From the foregoing discussion, it will be appreciated by those skilled in the art that the device for covering a surface that a person would lie, rest, and/or sit on in accordance with the present invention incorporates one or more support areas for supporting various portions of the body, which enhance the comfort of the user while serving to anchor or hold the device down. It will also be appreciated that the device incorporates one or more support areas, which may be filled with different types of support matter, such as sand, an inflatable pillow, or any other support device which may be weighted or unweighted.

It will further be appreciated that the device for covering a ground surface that a person would lay, rest, and/or sit on in accordance with the present invention incorporates a support area that is readily capable of being filled with sand before use and emptied following use. It will also be appreciated that the device incorporates one or more storage pockets for storing personal items and effects, such as, but not limited to, a wallet, key, comb, glasses, sunscreen lotion, book, and the like.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An ergonomic blanket for covering a surface, which comprises:

a main body portion adapted for being positioned between a person and a surface, the main body portion comprising a pair of opposing laterally extending end edges and a pair of opposing longitudinally extending side edges; and a support portion, at least a portion of the support portion being removably attached to the main body portion proximate to an end edge, the removable attachment extending laterally between the side edges, at least a portion of the support portion being substantially permanently attached to the main body portion between the end edges, the substantially permanent attachment extending laterally between the side edges, the main body portion and the support portion defining a pocket extending laterally and substantially contiguously from one of the side edges to the opposing side edge, the pocket being open at both side edges, the pocket adapted to retain support material therein.

2. An ergonomic blanket for covering a surface defined by claim 1, further comprising at least two support portions, each of said support portions being positioned proximate one of the opposing end edges.

3. An ergonomic blanket for covering a surface defined by claim 1, wherein the support material comprises at least one of sand, foam, feathers, polyester, homeopathic material, and air.

4. An ergonomic blanket for covering a surface defined by claim 1, wherein the support material comprises a pillow.

5. An ergonomic blanket for covering a surface defined by claim 4, wherein the pillow is inflatable.

6. An ergonomic blanket for covering a surface defined by claim 4, wherein the pillow comprises a weighted portion.

7. An ergonomic blanket for covering a surface defined by claim 1, further comprising a storage portion, at least a portion of the storage portion being removably attached to the blanket, at least a portion of the storage portion being substantially permanently attached to the blanket, the storage portion being adapted to retain personal items.

8. An ergonomic blanket for covering a surface defined by claim 7, wherein the storage portion is substantially removable from the blanket.

9. An ergonomic blanket for covering a surface defined by claim 1, wherein at least one of the main body portion and the support portion comprises terry cloth.

10. An ergonomic blanket for covering a surface defined by claim 1, wherein the removable attachment comprises at least one of buttons, snaps, and hook-and-loop fasteners.

11. A method of ergonomically covering a surface, which comprises:

providing a main body portion adapted for being positioned between a person and a surface, the main body portion comprising a pair of opposing laterally extending end edges and a pair of opposing longitudinally extending side edges;

providing a support portion;

attaching at least a portion of the support portion removably to the main body portion proximate to an end edge, the removable attachment extending laterally between the side edges; and attaching at least a portion of the support portion substantially permanently to the main body portion between the end edges, the substantially permanent attachment extending laterally between the side edges, the main body portion and the support portion defining a pocket extending laterally and substantially contiguously from one of the side edges to the opposing side edge, the pocket being open at both side edges, the pocket adapted to retain support material therein.

12. A method of ergonomically covering a surface defined by claim 11, further comprising:

providing at least two support portions; and positioning each of said support portions proximate one of the opposing end edges.

13. A method of ergonomically covering a surface defined by claim 11, wherein the support material comprises at least one of sand, foam, feathers, polyester, homeopathic material, and air.

14. A method of ergonomically covering a surface defined by claim 11, wherein the support material comprises a pillow.

15. A method of ergonomically covering a surface defined by claim 14, wherein the pillow comprises a weighted portion.

16. A method of ergonomically covering a surface defined by claim 11, further comprising:

providing a storage portion;

attaching at least a portion of the storage portion removably to the blanket; and attaching at least a portion of the storage portion substantially permanently to the blanket, the storage portion being adapted to retain personal items.

17. A method of ergonomically covering a surface defined by claim 16, further comprising adapting the storage portion to be substantially removable from the blanket.

18. A method of ergonomically covering a surface defined by claim 11, wherein at least one of the main body portion and the support portion comprises terry cloth.

19. A method of ergonomically covering a surface defined by claim 11, wherein the removable attachment comprises at least one of buttons, snaps, and hook-and-loop fasteners.

20. An ergonomic blanket system, which comprises:

a main body portion adapted for being positioned between a person and a surface, the main body portion comprising a pair of opposing laterally extending end edges and a pair of opposing longitudinally extending side edges;

a support portion, at least a portion of the support portion being removably attached to the main body portion proximate to an end edge, the removable attachment extending laterally between the side edges, at least a portion of the support portion being substantially permanently attached to the main body portion between the end edges, the substantially permanent attachment extending laterally between the side edges, the main body portion and the support portion defining a pocket extending laterally and substantially contiguously from one of the side edges to the opposing side edge, the pocket being open at both side edges, the pocket adapted to retain support material therein; and a storage portion, at least a portion of the storage portion being removably attached to the blanket, at least a portion of the storage portion being substantially permanently attached to the blanket, the storage portion being adapted to retain personal items.

* * * * *